United States Patent [19]

Peterson

[11] Patent Number: 4,836,466

[45] Date of Patent: Jun. 6, 1989

[54] WINCH ATTACHMENT FOR VEHICLE WHEEL TRACTION

[76] Inventor: Bradley M. Peterson, 540 S. Huber, Casper, Wyo. 82609

[21] Appl. No.: 112,554

[22] Filed: Oct. 26, 1987

[51] Int. Cl.[4] ..... B65H 75/34; B66D 3/00

[52] U.S. Cl. ..... 242/95

[58] Field of Search ..... 242/95; 254/323, 328

[56] References Cited

U.S. PATENT DOCUMENTS

| | | | |
|---|---|---|---|
| 2,127,858 | 8/1938 | Coleman | 242/95 |
| 3,099,416 | 7/1963 | Wright | 242/95 |
| 3,160,364 | 12/1964 | Bailey | 242/95 |
| 3,224,704 | 12/1965 | Bailey | 242/95 |
| 3,252,672 | 5/1966 | Scott | 242/95 |
| 3,278,159 | 10/1966 | Jack | 242/95 |
| 3,292,905 | 12/1966 | McCain | 242/95 |
| 3,392,961 | 7/1968 | McCain | 242/95 |
| 3,784,163 | 1/1974 | Swanson et al. | 242/95 |
| 4,135,681 | 1/1979 | Cooper | 242/95 |
| 4,568,036 | 2/1986 | Kearney | 242/95 |

*Primary Examiner*—Stanley N. Gilreath

[57] ABSTRACT

A winch assembly for attachment to a vehicle wheel, particularly mag wheels, which includes a drum attached to the wheel by a bolt having internal and external threads, the internal threads screwing onto the wheel studs. A cable spool is attached to the drum and has one end of a cable fixed thereto. The cable passes over fixed pulleys whereby operation of the vehicle wheels pulls the vehicle from mud, sand, snow, etc.

2 Claims, 2 Drawing Sheets

WINCH ATTACHMENT FOR VEHICLE WHEEL TRACTION

This invention relates to a wheel winch attachment mounted on the hub of a vehicle for the purpose of winching a vehicle out of mud or snow in which it no longer has traction to pull itself out. This happens frequently in off highway travel such as hunting or fishing or everyday duties in farm or ranch work.

The apparatus of this invention includes a spool mounted on a hub of a driven wheel with cable attached to spool in such a way that when the wheel turns, cable will tighten, pulling vehicle clear of mud or snow. The other end of the cable is attached to stakes or immovable objects.

There have been other inventions of similar wheel winch type. However, since mag wheels are relatively new, no design has been patented to mount on the new mag wheels.

The invention includes a special bolt for the attachment of drums to the mag wheels that overcomes the disadvantage that the other wheel winches have had in fastening their winches to mag wheels.

Because the mag wheels have a deep indenture around the wheel studs and the indenture being only 1" in width, the bolt can be no larger than ¾". These ¾" bolts have to be drilled and inside-threaded on one end to go over and screw onto the wheel stud of the mag wheel. The other end of the bolt has to be threaded on the outside to receive nut which holds the drum onto the hub. Without this special bolt there is no way to fasten the drum to the modern mag wheel.

In the preferred embodiment of the invention there is provided an outer cable winch spool with a telescoping cylinder welded to an inside plate of the spool.

The major hub drum has an inner diameter greater than the wheel stud diameter. The major hub drum is closed at the outer side having ¾" holes to receive special bolts and nuts. A hole in the periphery of the cable winch spool and a single cable passing through said hole and being secured by a cable clamp is the means for attaching the cable to the spool.

In the foregoing general description, I have set out certain objects, advantages and purpose of my invention. Other objects, advantages and purposes will be apparent from a consideration of the following description and the accompanying drawings in which.

Figure 1:
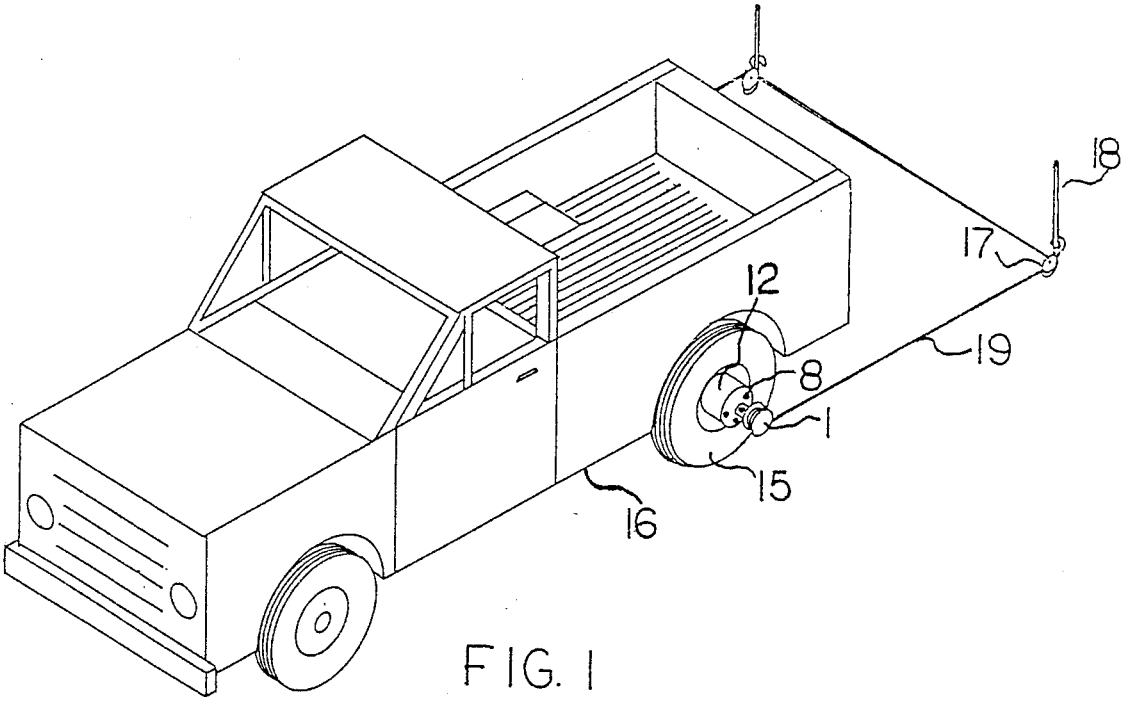
FIG. 1 is a perspective view of a vehicle using the device of my invention.

Referring to the drawing, FIG. 1, I have illustrated a vehicle such as a pickup truck having rear driven wheels (15). Drum (12) is fixed to wheel by special bolts and nuts (8), the special bolts screwing onto the wheel studs and engaging the periphery of openings on plate (13) of major drum (12). Cable (19) is tightened when outer cable spool (1) turns. With drums mounted on both rear drive wheels and a cable fastened to stakes (18) through equalizer pulleys (17), the truck will pull out of entrapment evenly as pulleys (17) will equalize the pull on stakes (18).

Figure 2:
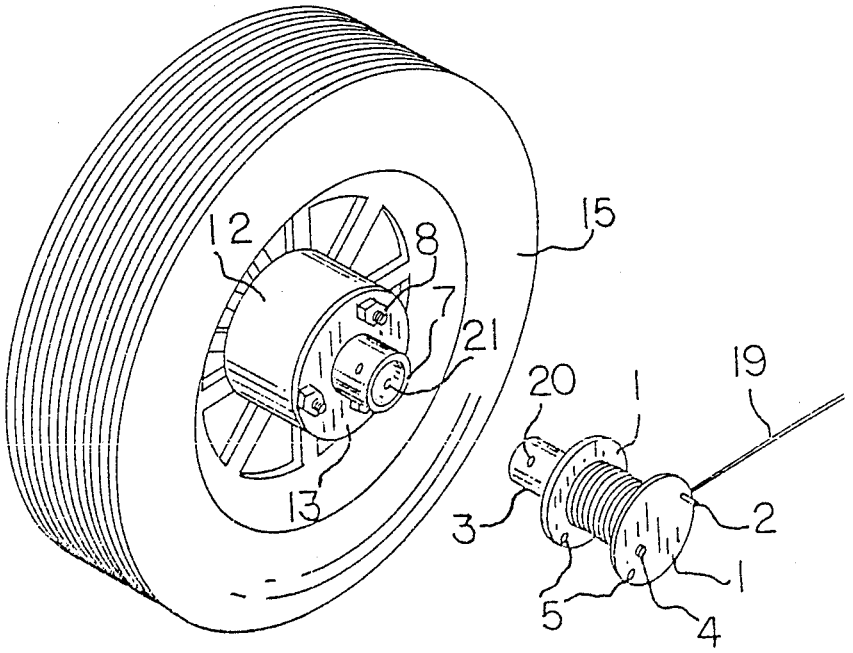
FIG. 2 is a perspective view of the wheel with the major drum bolted onto the hub. Also included in FIG. 2 is a perspective view of the outer cable spool.

Referring to the drawing, FIG. 2 shows a blown up view of wheel (15), major drum (12), major drum plate (13), telescoping cylinder (7) welded to plate of major drum (13), special bolts and nuts (8), and locking holes (21).

Referring to the outer cable spool, FIG. 2 shows telescoping cylinder (3) welded to inner spool plate (1), telescoping cylinder locking hole (20), auxiliary holes for cable storing (5), cable clamp and hole for retaining cable (4), winding handle welded onto outer plate for fast wind-up (2), outer plate (1).

Figure 3:
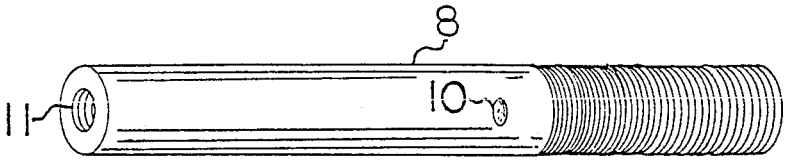
FIG. 3 is the side view of the special bolt.

Referring to drawing of FIG. 3 shows a blown up view of the special bolt. Inside threaded hole (11), hole for shaft type lever or bolt (10).

Figure 4:
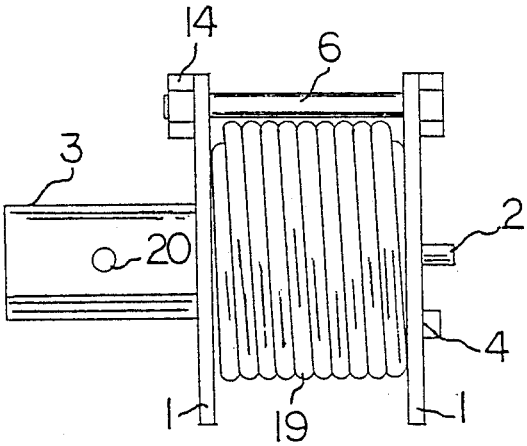
FIG. 4 is a side view of the outer cable spool.

FIG. 4 bolt or pin (6) has a triple purpose: as keeper for wound cable, locking bolt for telescoping shaft of drum and spool, and wrench lever for screwing in special bolts.

Figure 5:
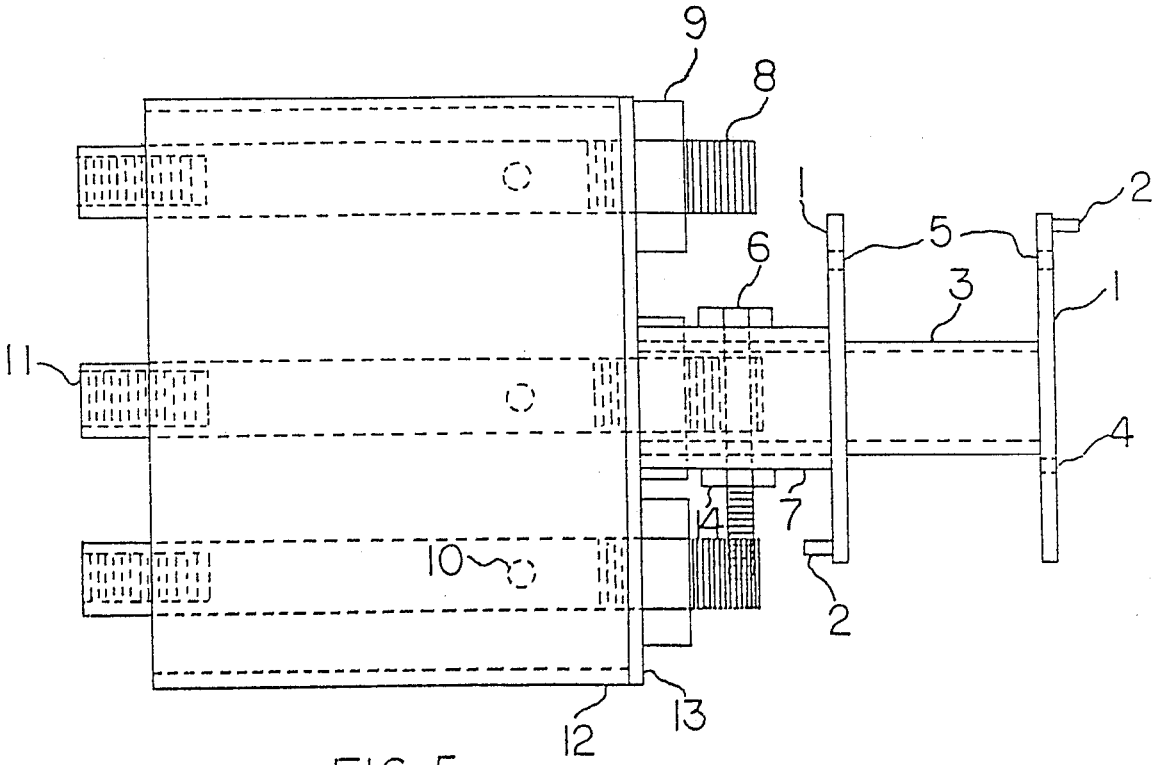
FIG. 5 is a side view of the major drum with outer cable spool in place.

Referring to FIG. 4 drawing shows side view of outside cable spool with cable wound and keeper bolt or pin (6) in place. Referring to FIG. 5 drawing shows full assembly of major drum (12), special bolts (8), cylinders (3, 7) locked in place and outside cable spool (1).

A vehicle with the device of my invention attached as hereinabove described is readily extracted from mud, sand, snow or similar material in which traction is unavailable by simply operating the drive wheels. The cable maintaining a constant and equal load on each wheel by reason of free passage of cable over pulley wheel will pull vehicle without sideturning or fouling of said cable.

While I have illustrated and described a present preferred embodiment of my invention in the foregoing general description, it will be understood that this invention may be otherwise embodied within the scope of the following claims.

I claim:

1. A winch assembly for attachment to a wheel of a vehicle, the wheel being attached to the vehicle by studs, said winch assembly comprising; a first hollow drum member having an end plate with plurality of holes therein, a plurality of bolts, one end of each of said bolts being hollow with internal threads, said bolts extending through said holes and said first hollow drum with said internal threads attached to said studs, a second hollow drum member fxed to said plate and extending axially therefrom opposite said first hollow drum member, a cable receiving spool having spaced end plates and a shaft, said shaft having a first portion extending between said plates for receiving a cable wound thereon and a second portion extending beyond one of said plates, and means for fixing said second portion of said shaft to said second hollow drum.

2. A winch assembly as claimed in claim 1, wherein said second shaft portion is received in said second hollow drum member, each of said second hollow drum member and said second shaft portion having a hole therethrough, and said means for fixing includes a pin extending through said holes.

* * * * *